United States Patent [19]

Sugimoto

[11] 4,404,715

[45] Sep. 20, 1983

[54] SAFETY-BELT BUCKLE OF SLIDE-UNLOCKING TYPE

[75] Inventor: Mutsumi Sugimoto, Hamamatsu, Japan

[73] Assignee: Katsuyama Kinzoku Kogyo Kabushiki Kaisha, Shizuoka, Japan

[21] Appl. No.: 391,743

[22] Filed: Jun. 24, 1982

[51] Int. Cl.[3] ..... A44B 11/00; A44B 11/06

[52] U.S. Cl. ..... 24/230 A

[58] Field of Search ..... 24/230 A, 230 AK, 230 AL, 24/230 AS, 230 R

[56] References Cited

U.S. PATENT DOCUMENTS

| | | | |
|---|---|---|---|
| 3,256,576 | 6/1966 | Klove, Jr. et al. | 24/230 R |
| 4,044,115 | 1/1977 | Esner | 24/230 A |
| 4,136,425 | 1/1979 | Esner | 24/230 A |
| 4,182,008 | 1/1980 | Pouget | 24/230 A |
| 4,310,952 | 1/1982 | Robben et al. | 24/230 A |
| 4,358,877 | 11/1982 | Burke | 24/230 A |
| 4,358,879 | 11/1982 | Magyar | 24/230 A |

*Primary Examiner*—Gene Mancene
*Assistant Examiner*—Paul S. Polakowski
*Attorney, Agent, or Firm*—Ladas & Parry

[57] ABSTRACT

When a tongue having a locking hole is inserted into a buckle, the edge of the locking hole is caught and locked by a catch of a rockable latch plate and is unlocked thereby when a slide button of the buckle is manually pressed in sliding movement, in which an inclined surface of the button actuates by wedge action lever-like arms of an actuating plate which, in turn, force a rockable link plate to rotate the latch plate until its catch releases the tongue. A number of springs are provided for return movements including a spring cocked by the inserted tongue for forcibly ejecting the tongue when it is released.

6 Claims, 6 Drawing Figures

SAFETY-BELT BUCKLE OF SLIDE-UNLOCKING TYPE

BACKGROUND OF THE INVENTION

This invention relates generally to safety belts and harnesses and to buckles and like fastening mechanisms therefor. More particularly the invention relates to buckles, specifically slide-unlocking type buckles, of safety belts such as seat belts suitable for use in motor vehicles (automobiles), other land craft, sea craft, and aircraft.

Needless to say, safety-belt buckles of the type referred to above must, in order to be commercially salable, meet certain requirements as specified by the safety standards of the countries in which they are to be sold, such as the EEC Rule 77541 of European countries and the MVSS of the United States. Of these requirements, those concerning the strength and durability of buckles are important. Others specify that safety-belt buckles must positively lock two ends of their belt straps in the fastened state and that, moreover, each buckle must be easily and promptly unlockable by a small manipulative force.

For example, the minimum tensile load which a locked buckle must withstand is an acceleration of 33 G (approximately 2.2 tons) depending on the EEC Rule. One requirement for maximum unlocking force is 6 kg for a buckle under tensile load of 30 Kg.

Heretofore, most of the seat-belt buckles have been of the kind comprising a buckle main mechanism secured to the free end of one belt strap and a tongue secured to the free end of an opposite belt strap and adapted to be inserted into the buckle main mechanism for locking. Almost all of the buckles of this character have been of the push-unlocking type, that is, of the type wherein the buckle is unlocked to release the locked tongue by manually pushing a push button. A buckle of this type has an advantageous feature in that it can be made to have a small overall size and a small thickness dimension.

Recently, however, there has been a diversification in the preferences of consumers, and there is a considerable demand not only for seat-belt buckles of the push-unlocking type but also for buckles of various other types.

SUMMARY OF THE INVENTION

It is an object of this invention to provide a seat-belt buckle of a slide-unlocking type which, while fully meeting all other requirements of safety standards, positively locks the tongue and readily releases the same when a slide button is pressed into sliding displacement with a small manipulative force, and which can be made light and small, particularly with a small thickness dimension.

According to this invention, briefly summarized, there is provided a safety-belt buckle characterized in that it comprises:

- a tongue adapted to be secured at a rear part thereof to a free end of one belt strap and having a locking opening at a front part thereof;
- a base plate adapted to be secured at a rear part thereof to a free end of another belt strap;
- a latch device mounted on the base plate and having a latch plate formed to have a locking catch capable of positively catching and thereby locking the forward edge of the locking opening of the tongue when the front part of the tongue is slidingly inserted into the latch device between the latch plate and the base plate through an insertion slot at the front end of the base plate;
- a link plate which is rockably supported on trunnions journaled in side flanges of the base plate, and which has engagement slots disposed forward of the trunnions and adapted to engage the rear edge of the latch plate, engagement lugs disposed rearward of the trunnions, and spring parts for pressing the latch plate toward the base plate;
- an actuating plate elastically and pivotally supported on the side flanges of the base plate and having forwardly projecting arms, intermediate parts of which are engaged with the engagement lugs of the link plate;
- a casing cover mounted on the base plate and functioning cooperatively therewith to protectively cover and accommodate the above enumerated parts; and
- a slide button which is partly accommodated within the casing cover and so supported thereby as to be slidable in the front-rear directions of the base plate and is continually biased forward by spring force, and which has inclined surfaces engageable with the free front ends of the projecting arms of the actuating plate,
- the tongue in locked state being unlocked by pressing the slide button rearward against the spring force, whereby the inclined surfaces thereof press the actuating plate toward the base plate thereby to cause the link plate to move the rear edge of the latch plate away from the base plate, and the locking catch is thereby disengaged from the front edge of the locking opening of the tongue, which is thereby released.

The nature, utility, and further features of this invention will be more clearly apparent from the following detailed description with respect to a preferred embodiment thereof when read in conjunction with the accompanying drawings, briefly described below.

Figure 1:
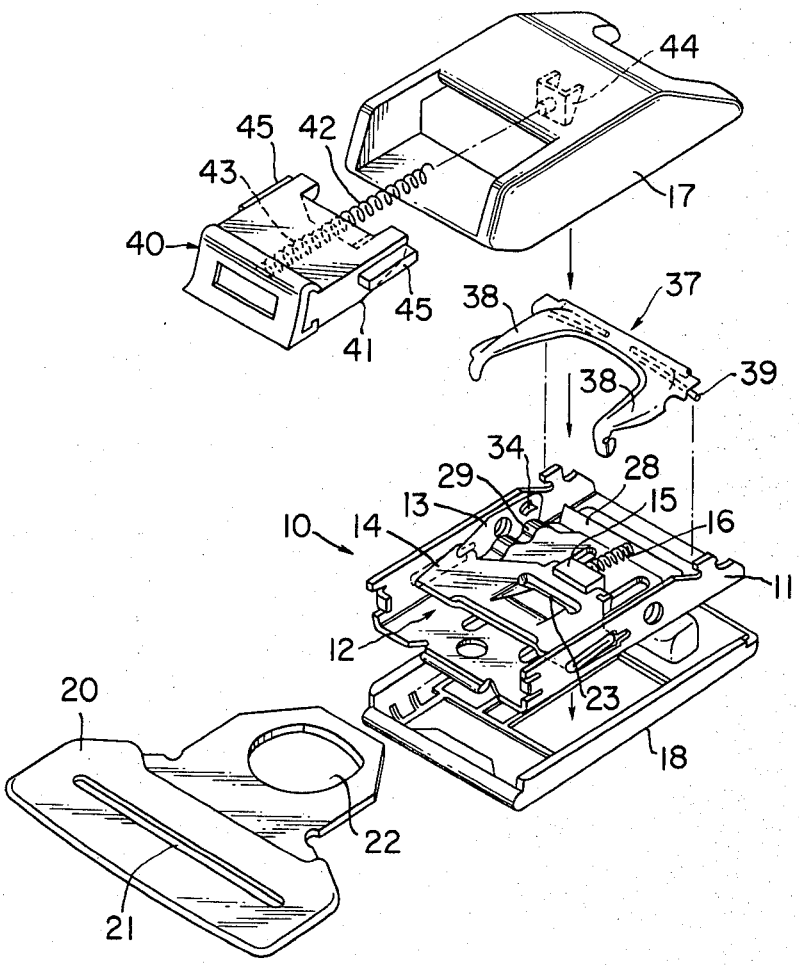
FIG. 1 is an exploded perspective view of one example of a slide-unlocking type safety-belt buckle according to this invention for seat belts.

Throughout this disclosure, for convenience in description, up and down directions as designated by related terms are those as viewed in the drawings. Forward and rearward directions concerning the buckle main structure 10 are respectively toward and away from the tongue 20, or toward the left and right in FIGS. 3 through 6. Those concerning the tongue 20 are toward and away from the buckle main structure 10.

DETAILED DESCRIPTION OF THE INVENTION

Referring first to FIG. 1, which is an exploded perspective view of the example of the seat-belt buckle of the invention, the buckle has a main structure 10 having a base plate 11 and a latch device 12 and a link plate 13 attached to the base plate 11. The latch device 12 is constituted by a latch plate 14, a press slider 15 for engaging with the rear end of the latch plate 14, and a compression spring 16 for elastically urging the press slider 15 in the forward direction. The buckle main structure 10, furthermore, is covered by and accommodated within an upper cover 17 and a lower cover 18. These covers 17 and 18 are formed by molding a material such as a synthetic resin.

A tongue 20 is designed to be inserted into and locked in the buckle main structure 10 and to be unlocked and extracted from the same. This tongue 20 has at its rear part a slot 21 for securing thereto the loose or free end of a first seat-belt strap (webbing) (not shown) and at its front part a locking opening 22. The locking opening 22 of the tongue 20 is so adapted that its front edge can be engaged or caught by a locking catch 23 of the latch plate 14 when the tongue 20 is inserted into an insertion slot 19 formed between the upper and lower covers 17 and 18 and is thereby locked as described more fully hereinafter. The locking catch 23 is projecting from the latch plate 14 toward the base plate 14.

Figure 2:
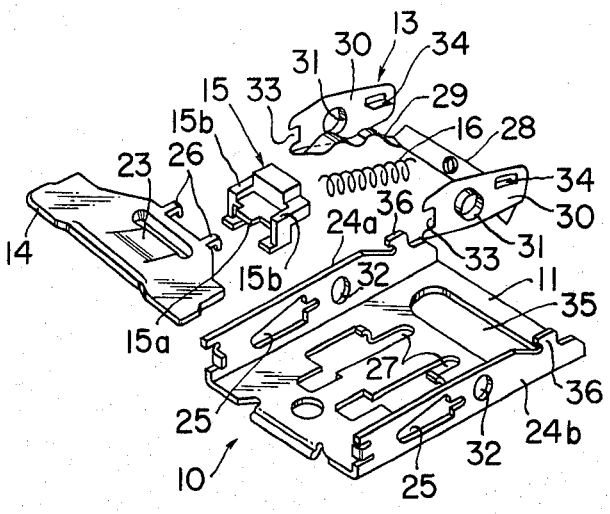
FIG. 2 is an exploded perspective view of a buckle main structure of the same safety-belt buckle.

The buckle main structure 10 has a construction as shown in FIG. 2. The base plate 11 has upwardly bent side flanges 24*a* and 24*b* along its lateral sides. At transversely opposed positions in these two side flanges 24*a* and 24*b*, attachment holes 25, 25 of sectorial shape are respectively formed to receive lugs on the two side edges of the latch plate 14, which is thereby supported in a manner permitting it to swing freely about a transverse axis. The latch plate 14 has at its rear edge a pair of transversely spaced apart claws 26, 26 for engagement with engagment surfaces 15*b*, 15*b* of the press slider 15.

The base plate 11 further has a pair of guide slots 27, 27 of symmetrical shape and transverse position extending in the longitudinal or forward-rearward direction. Lower parts of the above mentioned press slider 15 are slidably engaged with these guide slots 27, 27. The above mentioned compression spring 16 is interposed between the rear part of this press slider 15 and a spring retainer of a crosspiece 28 of the link plate 13 and continually exerts an elastic forward force on the press slider 15.

The link plate 13 has the crosspiece 28, corrugated spring parts 29, 29 extending forward from respective ends of the crosspiece 28, and side plate parts 30, 30 connected to the free end outer sides of the corrugated spring parts 29, 29. The side plate parts 30, 30 have at their middle parts trunnions 31, 31 extending coaxially outward and journaled in journals 32, 32 formed in the above described side flanges 24*a* and 24*b* of the base plate 11. The side plate parts 30, 30 are provided at their front edges with engagement slots 33, 33 for meshing engagement with the rear edge of the latch plate 14 and at positions to the rear of the trunnions 31, 31 with inwardly-projecting engagement lugs 34, 34.

In the assembled state of the above described mechanism, the spring parts 29, 29 of the link plate 13 are acting by way of the engagement slots 33, 33 to press the rear part of the latch plate 14 toward the side of the base plate 11, whereby the aforedescribed tongue 20, upon being inserted through the insertion slot 19 and between the base plate 11 and the latch plate 14, is clamped therebetween. When the tongue 20 has been thus inserted up to a specific position, the locking catch 23 of the latch plate 14 enters the locking opening 22 of the tongue 20 and engages with the front edge of this opening 22, thereby locking the tongue 20. As mentioned hereinabove, the locking catch 23 is projecting from the latch plate 14 toward the base plate 11.

An opening 35 for securing the loose end of second seat-belt strap (webbing) (not shown) is formed in the base plate 11 at its rear part. Engagement hooks 36, 36 are formed on the top edges of the above described side flanges 24*a* and 24*b* of the base plate 11 at their rear part. A base part of an actuating plate 37 is fitted in and supported by these engagement hooks 36, 36. The actuating plate 37 as a whole is U-shaped with arms 38, 38 projecting forwardly from the base part. Furthermore, the base part of the actuating plate 37 has a spring member 39 having arms extending laterally sidewise and functioning to continually bias the actuating plate 37 in the direction such that its arms 38, 38 tend to separate from the base plate 11.

The projecting arms 38, 38 have at their intermediate parts contact parts capable of engaging the engagement lugs 34, 34 of the link plate 13. The projecting arms 38, 38 have smoothly curved free ends which can be engaged by inclined surfaces 41, 41 of a slide button 40.

The slide button 40 is slidably accommodated within the upper cover 17 and is urged elasticly forward by a compression spring 42. This compression spring 42 is interposed under compression between a spring retaining hole 43 in the rear part of the slide button 40 and a spring retaining seat 44 fixed to the upper cover 17 at a specific position in the interior thereof. The slide button 40 is prevented from being pushed forwardly out of the upper cover 17 by stops 45 fixed to opposite sides thereof.

Figure 3:
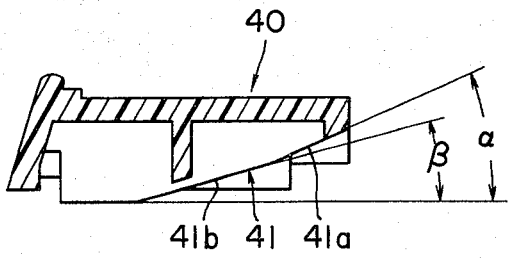
FIG. 3 is a side view, in longitudinal section, of a slide button to be assembled in the same safety-belt buckle.

Each of the above mentioned inclined surfaces 41, 41 of the slide button 40 is sloped upward toward the right as shown in FIG. 3. Each inclined surface 41 has a first inclined part of large slope angle $\alpha$ and a second inclined part of small slope angle $\beta$. Thus, each inclined surface 41 of the slide button 40 is inclined in stages of a number which is two in the instant example (but which may be more), the slope angles of which increase successively toward the rear end or the leading end of the slide button 40 in the direction in which it is to be pressed. When the slide button 40 is pressed rearward during its operation, the first inclined parts 41*a*, 41*a* first engage the projecting arms 38, 38 of the actuating plate 37, and then the second inclined parts 41*b*, 41*b* engage the projecting arms. When the second inclined parts 41*b*, 41*b* engage the actuating plate 37, the intermediate parts of the projecting arms 38, 38 of the actuating plate 37 engage the engagement lugs 34, 34 of the link plate 13 and press these engagement lugs 34, 34 against the spring force of the spring parts 29, 29.

The seat-belt buckle of the above described construction according to this invention is operated and functions in the following manner.

Figure 4:
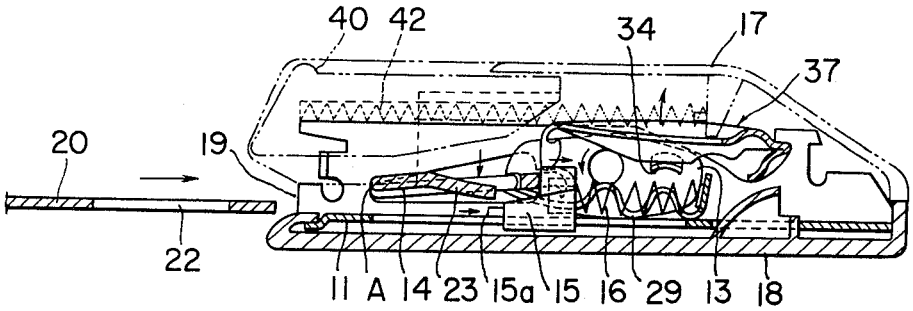
FIG. 4 is a side view, in longitudinal section, showing the same assembled safety-belt buckle in the state prior to insertion of the mating tongue.

As shown in FIG. 4, for fastening the seat belt, the tongue 20 is inserted through the insertion slot 19 and into the space between the base plate 11 and the latch plate 14. When the tongue 20 is thus inserted, its leading edge engages the forward projecting surface 15*a* of the press slider 15 and forces this slider 15 rearward, overcoming the spring force of the compression spring 16 and further compressing this spring.

Figure 5:
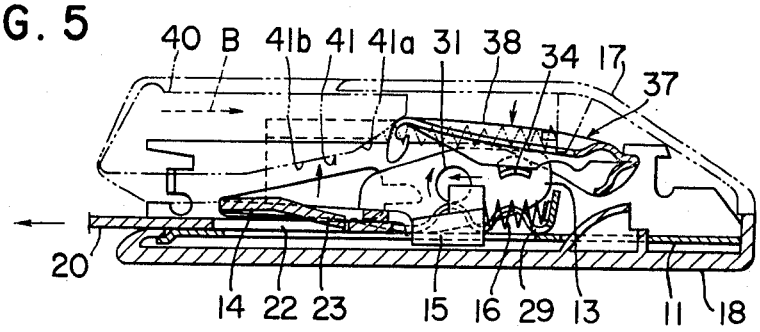
FIG. 5 is a side view, similar to FIG. 4, showing the buckle in the locked state.

When the press slider 15 is pressed to a specific position (lock position), the claws 26, 26 of the latch plate 14 becomes disengaged from the engagement surfaces 15*b*, 15*b* of the press slider 15, and the latch plate 14 is rotated clockwise (as viewed in FIGS. 4 and 5) or downward about a pivot point A at the front ends of the attachment holes 25, 25 in the side flanges 24*a* and 24*b* of the base plate 11. The buckle mechanism 10 thereby assumes the locked state together with the tongue 20 as shown in FIG. 5. The latch plate 14 is thus rotated clockwise about the pivot point A by the spring force of the spring parts 29, 29 of the link plate 13.

As a consequence of this rotation of the latch plate 14, its rear part is pressed toward the base plate 11, and its locking catch 23 clicks into engagement with the front edge of the locking opening 22 of the tongue 20. As a result, the tongue 20 is caught and prevented from slipping out, that is, it is locked to and by the buckle main structure 10. When the buckle and tongue are in this locked state, the press slider 15 is retained or cocked in its retracted position, and the link plate 13 is retained in its position shown in FIG. 5, having rotated counterclockwise from its position indicated in FIG. 4. At the same time, the engagement lugs 34, 34 of the link plate 13 are retained in their positions of separation from the base plate 11 (upper position in FIG. 5).

When the tongue 20 is to be released from the above described locked state, the slide button 40 is pressed and caused to slide toward the rear of buckle main structure 10, that is, in the arrow direction B shown in FIG. 5, whereupon its inclined surfaces 41, 41 engage the free ends of the projecting arms 38, 38 of the actuating plate 37. First, the first inclined parts 41*a*, 41*a* come into engagement with the projecting arms 38 and cause these projecting arms 38 to rotate counterclockwise (as viewed in FIG. 5) about the pivotal proximal part of the actuating plate 37.

When, with the mechanism in this state, the rearward pressing of the slide button 40 is continued, the actuating plate 37 is further rotated until it engages the engagement lugs 34, 34 of the link plate 13. At this time, the second inclined parts 41*b*, 41*b* of the inclined surface 41 become engaged with the projecting arms 38, 38 of the actuating plate 37. Then, when the slide button 40 is further pressed rearward, the link plate 13 is rotated clockwise against the spring force of its spring parts 29, 29 by a wedge action of the second inclined parts 41*b*, 41*b* and a lever action of the actuating plate 37 and is brought into the state indicated in FIG. 6.

Figure 6:
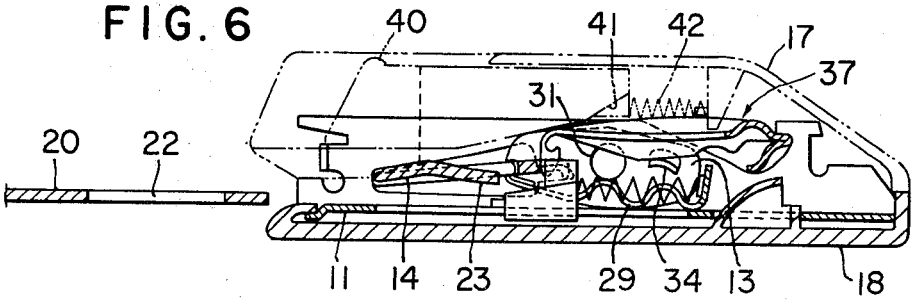
FIG. 6 is a side view, similar to FIGS. 4 and 5, showing the buckle in its state wherein it has released the tongue.

When the link plate 13 assumes its state indicated in FIG. 6, its engagement slots 33, 33 press upward the rear part of the latch plate 14. As a consequence, the claws 26, 26 of the latch plate 14 disengage from the press slider 15, and, at the same time, the locking catch 23 of the latch plate 14 disengages from and releases the front edge of the locking opening 22 of the tongue 20. Consequently, the press slider 15 is moved forward by the spring force of the compression spring 16, which has been compressed in the locking operation, and the engagement surface 15*a* of the press slider 15 presses forward against the leading edge part of the tongue 20, which is thereby ejected forcibly out of the buckle main structure 10 and thus released from its locked state.

Then, when the slide button 40 is released by removing the hand therefrom, the slide button 40 is returned to its original position by the spring force of the compression spring 42, and the mechanism assumes the state shown in FIG. 4.

While this invention has been described above with respect to one embodiment thereof wherein the buckle mechanism is enclosed within a cover of split construction comprising upper and lower covers, the lower cover is not absolutely necessary in all cases. Alternatively, a suitable decorative material may be attached directly to the bottom (outer) surface of the base plate of the buckle main structure, or a resin material may be bonded integrally to the bottom surface by a resin working process.

A noteworthy feature of the buckle according to this invention is that, as described above, by utilizing both a wedge action of the inclined surface of the slide button and a lever action of the actuating plate transmitted by way of the link plate, the tongue is released from its locked state, whereby, by merely pressing the slide button in sliding movement with a small pressing force, the tongue can be positively released.

Another feature of the buckle of this invention is that the tongue can be retained in positively locked state when it is inserted into the buckle since, in this state, the locking catch of the latch plate is positively engaged against the front edge of the lock opening of the tongue, and, at the same time, the latch plate, acted upon by the spring force of the link plate and the pressing force of the press slider, is supported in its locking state.

Furthermore, because the buckle of this invention is of the slide type, the slide button can be caused to slide by effectively utilizing dead space in conventional buckles of the push type, and there is no necessity of new or additional space for causing the slide button to thus slide. For this reason, various advantages such as small size, light weight, and small thickness dimension of the entire buckle are afforded.

In the case of one example of the safety-belt buckle according to this invention, it was found as a result of tests that the tensile load withstood by the locked buckle was approximately 4,500 kg by using double webbings, and the pressing force needed to unlock the locked buckle under a tensile load of 30 kg was approximately 4 kg.

In the case of one example of the safety-belt buckle of this invention, the overall dimensions of the buckle main structure are approximately $70 \times 45 \times 25$ mm, and its weight is approximately 90 grams. The tongue for this buckle weighs 57 grams.

While the safety-belt buckle of this invention has been described with respect to an embodiment thereof intended principally for use with seat belts of vehicles, it should be understood that the principle and teachings of this invention are applicable also to other forms of safety belts and straps such as, for example, those of parachutes and equipment for dangerous climbing and life saving.

What is claimed is:

1. A safety-belt buckle characterized in that it comprises:

a tongue (20) adapted (21) to be secured at a rear part thereof to a free end of one belt strap and having a locking opening (22) at a front part thereof;

a base plate (11) adapted (35) to be secured at a rear part thereof to a free end of another belt strap;

a latch device (12) mounted on the base plate and having a latch plate (14) formed to have a locking catch (23) capable of positively catching and thereby locking the forward edge of the locking opening of the tongue when the front part of the tongue is slidingly inserted into the latch device between the latch plate and the base plate through an insertion slot (19) at the front end of the base plate;

a link plate (13) which is rockably supported on trunnions (31, 31) journaled in side flanges (24*a*, 24*b*) of the base plate, and which has engagement slots (33, 33) disposed forward of the trunnions and adapted to engage the rear edge of the latch plate, engagement lugs (34, 34) disposed rearward of the trunnions, and spring parts (29, 29) for pressing the latch plate toward the base plate;

an actuating plate (37) elastically and pivotally supported on the side flanges of the base plate and having forwardly projecting arms (38, 38), intermediate parts of which are engaged with the engagement lugs of the link plate;

a casing cover (17) mounted on the base plate and functioning cooperatively therewith to protectively cover and accommodate the above enumerated parts; and a slide button (40) which is partly accommodated within the casing cover and so supported thereby as to be slidable in the front-rear directions of the base plate and is continually biased forward by spring force (42), and which has inclined surfaces (41, 41) engageable with the free front ends of the projecting arms of the actuating plate, the tongue in locked state being unlocked by pressing the slide button rearward against the spring force, whereby the inclined surfaces thereof press the actuating plate toward the base plate thereby to cause the link plate to move the rear edge of the latch plate away from the base plate, and the locking catch is thereby disengaged from the front edge of the locking opening of the tongue, which is thereby released.

2. A safety-belt buckle according to claim 1 in which the actuating plate (37) is U-shaped, comprising the projecting arms (38, 38) and a transverse base part fixedly joining at its ends the proximal ends of the arms, the transverse base part at its ends being pivotally engaged with engagement hooks (36, 36) formed in the side flanges (24*a*, 24*b*) of the base plate (11), and the link plate (13) comprises, as an integral structure, a transversely disposed crosspiece (28), the spring parts (29, 29) respectively fixed at proximal ends thereof to the ends of the crosspiece and extending forward, and side plate parts (30, 30) respectively fixed at front parts to the front distal parts of the spring parts substantially perpendicularly thereto, the engagement slots (33, 33) being respectively formed in the front edge of the side plate parts, the trunnions (31, 31) being respectively fixed to the middle parts of the side parts and coaxially extending laterally outward therefrom, the engagement lugs (34, 34) being respectively formed at the rear parts of the side plate parts and extending inward therefrom.

3. A safety-belt buckle according to claim 2 in which the transverse base part of the actuating plate (37) has spring members (39, 39) joined at a common proximal part thereof to the base part and branching transversely outward in opposite directions therefrom, the spring members continually exerting a spring biasing force urging the projecting arms (38, 38) of the actuating plate to rotate away from the base plate (11).

4. A safety-belt buckle according to claim 1 in which each of the inclined surfaces (41, 41) of the slide button (40) is sloped away from the base plate (11) in the direction of sliding insertion of the slide button for unlocking the buckle and is so formed that the slope angle thereof increases in said direction.

5. A safety-belt buckle according to claim 4 in which each of the inclined surfaces (41, 41) of the slide button (40) comprises a first inclined part (41*a*) at the leading portion thereof in said direction of sliding insertion of the slide button and a succeeding second inclined part (41*b*), the slope angle ($\alpha$) of the first inclined part being greater than that ($\beta$) of the second inclined part.

6. A safety-belt buckle according to claim 1 in which the latch device (12) has, in addition to the latch plate (14), a press slider (15) engageable with the insertion end of the tongue (20) and a compression spring (16) for continually exerting a spring bias force to the press slider urging it to move forward toward latch plate.

* * * * *